United States Patent [19]

Nishimura et al.

[11] Patent Number: 4,676,090

[45] Date of Patent: Jun. 30, 1987

[54] PRESS MACHINE WITH AN ADJUSTABLE SHUT HEIGHT

[75] Inventors: Tatsuo Nishimura, Yokohama; Tatsuya Tamura, Kanagawa, both of Japan

[73] Assignees: Hashimoto Forming Industry Co., Ltd., Kanagawa; Kabushiki Kaisha Shibakawa Seisakusho, Kawaguchi, both of Japan

[21] Appl. No.: 665,943

[22] Filed: Oct. 29, 1984

[30] Foreign Application Priority Data

| | | | |
|---|---|---|---|
| Oct. 31, 1983 | [JP] | Japan | 58-205456 |
| Oct. 31, 1983 | [JP] | Japan | 58-205457 |
| Oct. 31, 1983 | [JP] | Japan | 58-205458 |
| Oct. 31, 1983 | [JP] | Japan | 58-169470[U] |

[51] Int. Cl.[4] ..... B21J 13/03

[52] U.S. Cl. ..... 72/404; 72/455; 72/413; 72/473; 72/472; 72/446; 83/527; 100/257

[58] Field of Search ..... 72/404, 455, 456, 413, 72/472, 473, 481, 482, 446, 448; 29/34 R; 83/527, 530; 100/257

[56] References Cited

U.S. PATENT DOCUMENTS

| | | | |
|---|---|---|---|
| Re. 3,741 | 11/1869 | Howard | 72/473 |
| 144,969 | 11/1873 | Evans | 72/404 |
| 174,107 | 2/1876 | Boomer | 100/257 |
| 245,036 | 8/1881 | Weir | 72/404 |
| 282,747 | 8/1883 | Merriman | 83/527 |
| 364,142 | 5/1887 | Stiles | 72/446 |
| 1,437,953 | 12/1922 | Baily | 72/404 |
| 1,788,071 | 1/1931 | Strout | 100/257 |
| 2,334,520 | 11/1943 | Walters . | |
| 2,439,725 | 4/1948 | Frost | 100/70 |
| 2,592,152 | 4/1952 | Johansen | 100/257 |

FOREIGN PATENT DOCUMENTS

| | | | |
|---|---|---|---|
| 597346 | 11/1925 | France | 83/527 |
| 2204490 | 5/1974 | France . | |
| 1444598 | 9/1976 | United Kingdom . | |

*Primary Examiner*—Daniel C. Crane

*Attorney, Agent, or Firm*—Stevens, Davis, Miller & Mosher

[57] ABSTRACT

A press machine is disclosed which is provided with a plurality of press dies fixedly secured on a bolster. The machine has a vertically reciprocable frame member with a predetermined constant stroke, which carries a plurality of pressure plates cooperating with the die, respectively. Each pressure plate is axially movable with respect to the frame member and threadedly connected with a spacer plate arranged between the frame member and the pressure plate. The shut height of the machine can be individually adjusted for each pressure plate, by rotating the spacer plate relative to the pressure plate. The shut height can be optimized very easily and in short a time so that the productivity can considerably be improved.

12 Claims, 32 Drawing Figures

PRESS MACHINE WITH AN ADJUSTABLE SHUT HEIGHT

BACKGROUND OF THE INVENTION

1. Field of the Invention:

The present invention relates to a mechanical press machine for press forming various kind of components for automobiles and buildings, such as moldings, window sashes and the like.

2. Description of the Prior Art:

Conventionally, when moldings or sashes for automobiles, for example, are produced by press forming operation, an elongate profiled member formed from metal strip or extruded plastic material is cut into the desired length, and then subjected to local cutting, bore formation, bending, drawing or the like, by using a press machine. More particularly, referring to FIGS. 1A to 1D, in order to produce a weather strip belt molding M, for example, which consists of co-extruded thermoplastic polyvinyl chloride resin and stainless steel strip, the co-extruded elongate body is cut into a predetermined length (FIG. 1A). When the elongate profiled body has a relatively complex cross-sectional shape, undesirable deformation of the profiled body tends to occur during the cutting, so that in many cases, it is necessary to effect re-cutting for trimming the cutting edge f of the profiled body. Subsequently, the cutting edge and outer surface portion A are cut away locally (FIG. 1B), and the lower portion B is also cut away locally while the web portion of the profiled body is formed with a square opening C to be connected with a clip or fastener (FIG. 1C). Finally, the end portion D is bent into desired configuration (FIG. 1D). In order to carry out the above-mentioned various press operations in a mass-production factory, it has been a conventional practice to use a plurality of so-called floating press die, with a plurality of press machines arranged along a linearly extending conveyer, requiring a plurality of operating personnels.

Recently, however, in the automobile industry for example, with a great variety of needs of both consumers and manufacturers, a so-called just-on-time manufacturing system (so-called Kanban system) has been widely employed by which unnecessary stocks are to be minimized and a necessary number of required components are promptly produced and delivered to manufacturers whenever necessary. To follow the manufacturer's just-on-time system, for example, all the above-mentioned press operations for producing the molding M should be operated by a single personnel by using one press machine having a plurality of press dies. To make it possible, since the stroke of the press machine, i.e. the distance between the upper and lower dead points of the ram is constant and cannot be changed, an optimum operating condition with respect to a particular press die can be obtained only by adjusting the so-called shut height which is the distance between the upper surface of the bolster of the machine and the lower dead point of the ram. However, the adjustment of the shut height encounters the following problems. Namely, when press dies are secured to the machine and used in trial operation, particularly in case of drawing or bending dies, adjustment of working stroke often becomes necessary by an amount of e.g. 1 to 5 mm. In case of excessive stroke, the adjustment is carried out by grinding the bottom surface of the die, whereas, in case of insufficient stroke, additional plate is inserted between the bolster and the die. On the other hand, when the shut height of the entire machine is adjusted with respect to one particular die only, the shut height for the remaining dies may be inadequate. Furthermore, a slight difference in the bending characteristic cannot be eliminated for each lot of materials, so that the adjustment should be effected with respect to each lot of materials. As shown in FIG. 2, optimum shut height $H_1'$, $H_2'$, $H_3'$, $H_4'$, i.e. the distance between the lower dead points and the bolster upper surface for respective dies $D_1$, $D_2$, $D_3$, $D_4$ are different from each other, so that it is at all impossible, with conventional press machines, to obtain the optimum shut height for each of the dies. The open height positions are shown as $H_1$, $H_2$, $H_3$, $H_4$ in FIG. 2.

SUMMARY OF THE INVENTION

Therefore, it is an object of the present invention to provide a novel press machine with a plurality of dies, for which a desired shut height adjustment can be effected individually and very easily in short a time, and the die setting time can be reduced, thereby considerably improving the productivity.

Another object of the present invention is to provide a shut height adjusting means which may readily be combined with existing conventional press machines.

According to the present invention, there is provided a press machine which comprises a stationary frame member, a bolster which is fixedly mounted on the stationary frame member and on which a plurality of press dies are fixedly secured, and a movable frame member arranged reciprocably with respect to the stationary frame member and having a predetermined constant stroke, said movable frame member carrying a plurality of pressure plates cooperating with the press dies, respectively, wherein each pressure plate is axially movably supported by, and with respect to the movable frame member, and is threadedly connected with a spacer plate arranged between the lower surface of the movable frame member and the upper surface of the pressure plate, whereby the spacer plate is rotatable relative to the pressure plate to provide a desired shut height.

DESCRIPTION OF THE PREFERRED EMBODIMENTS

Figure 1A:
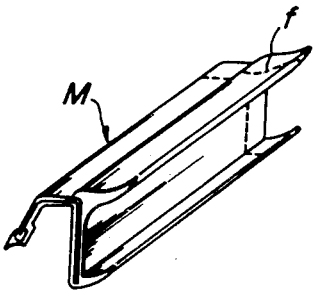
FIGS. 1A to 1D show various production steps of one exemplary component product by a press machine.
Figure 1B:
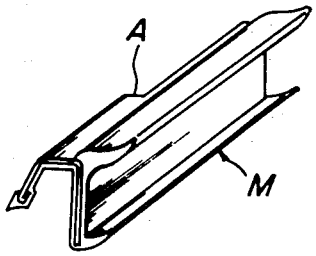
Figure 1C:
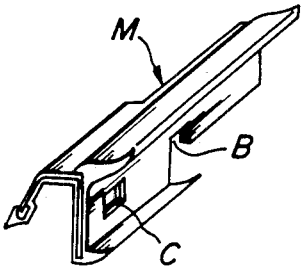
Figure 1D:
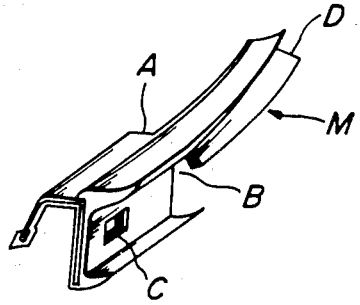
Figure 2:
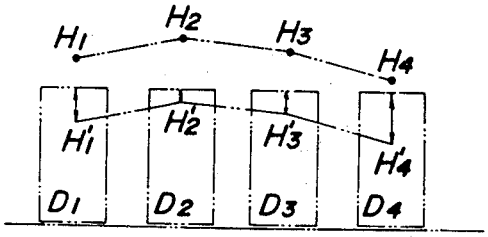
FIG. 2 shows the relation between a plurality of press dies and the respective shut heights.
Figure 3A:
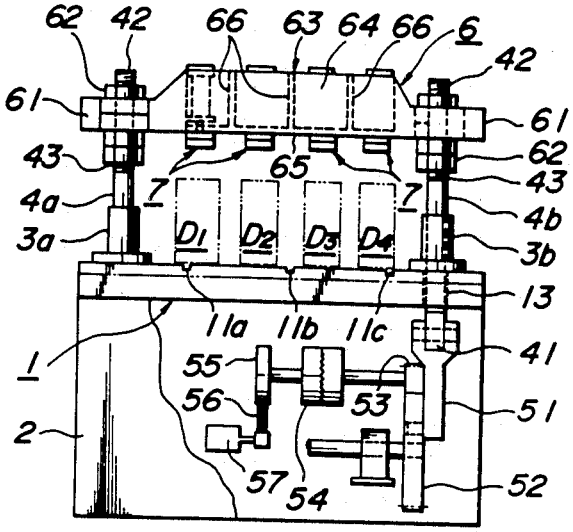
FIGS. 3A and 3B are front view and side view of a press machine according to one embodiment of the present invention.
Figure 3B:
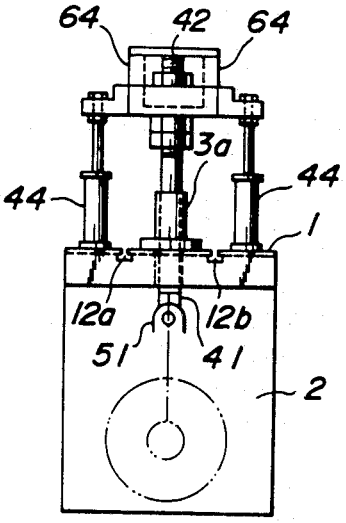

Referring now to FIGS. 3A and 3B, there is shown a press machine according to a first embodiment of the present invention, which includes a die bolster 1 in the form of a substantially rectangular plate fixedly mounted on a machine frame 2. A plurality of press dies $D_1$, $D_2$, $D_3$, $D_4$ are fixedly mounted on the die bolster 1. More particularly, the upper surface of the die bolster 1 is formed with transversely extending grooves 11*a*, 11*b*, 11*c*, as shown in FIG. 3A, which accommodate therein guide roller means (not shown) for permitting the sliding movement of the dies $D_1$, $D_2$, $D_3$, $D_4$ when mounting them. The upper surface of the die bolster 1 is further formed with longitudinally extending continuous grooves 12*a*, 12*b* of substantially inverted T-shape, as shown in FIG. 3B, for accommodating therein and engaging with portions of clamp means (not shown) by which the press dies $D_1$, $D_2$, $D_3$, $D_4$ are clamped and fixed on predetermined locations of the bolster 1. On both longitudinal end portions of the bolster 1, substantially at the transverse mid points thereof, a pair of vertical cylindrical guide posts 3*a*, 3*b* are fixed, e.g. by bolts, within which guide rods 4*a*, 4*b* are vertically slidably supported. For each of the guide rods 4*a*, 4*b*, the lower portion extends through a bore 13 formed in the bolster 1, and has a flat end 41 connected with one end of a connecting rod 51 by means of a pin. The other end of the connecting rod 51 is fitted into a recess formed in the side surface of a flywheel 52 whose outer periphery is formed with gear teeth. Although not shown in the drawings, a further flywheel is provided on the left side of FIG. 3A, having a structure indentical with that of the flywheel 52 on the right side. The two flywheels are connected with each other through a shaft. A gear wheel 53 meshed with the gear teeth of the flywheel 52 is connected with a pulley 55 via a clutch 54 which may be of either pneumatic type or electromagnetic type. This pulley 55 engages with a V-belt 56 connecting the pulley 55 with an electric motor 57 which, when actuated, displaces the guide rods 4*a*, 4*b* for vertical reciprocation, in a manner known per se.

The upper portions 42 of the guide rods 4*a*, 4*b* are provided with external threads 43, and are fixedly secured to longitudinal end portions 61 of an upper frame member 6 by means of nuts 62, respectively. The vertical position of the upper frame member 6 can be adjusted by suitably selecting the vertical position of the nuts 62 along the external threads 43. In order to increase the flexural rigidity of the upper frame member 6 against vertical bending force, the frame member 6 has an intermediate portion 63 whose width in the vertical direction is greater than those of the end portions 61, and may be formed of integral casting or steel sheets welded together. The intermediate portion 63 has a substantially through-like cross section defining therein inner spaces, and consists of front and rear side walls 64, a bottom wall 65 and three reinforcing partition walls 66 connecting the front and rear walls 64 with each other. In order to prevent mis-alignment of the guide rods 4*a*, 4*b* when they are displaced vertically, and to thereby permit a well balanced reciprocal motion of the frame member 6, the frame member 6 is supported by pneumatic cylinder-piston devices 44 as shown in FIG. 3B. These devices are normally supplied with air through one of the inlet ports only, such that the piston rods of the devices are maintained in their extended position.

Figure 4A:
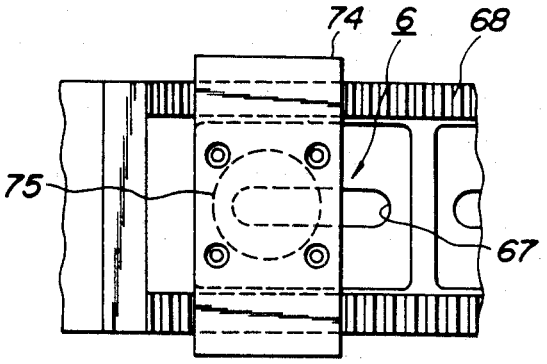
FIGS. 4A and 4B are enlarged fragmentary plan view and longitudinal sectional view, showing one preferred example of shut height adjusting means of the present invention.
Figure 4B:
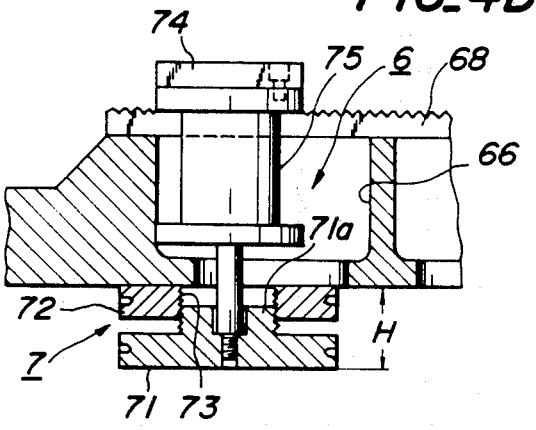

The upper frame member 6 is provided with means 7 which makes it possible to individually adjust the shut height with respect to each of the dies $D_1$, $D_2$, $D_3$, $D_4$. As shown in FIGS. 4A and 4B, the adjusting means 7 includes a disk-shaped pressure plate 71 and a ring-like spacer plate 72. The pressure plate 71 has a cylindrical center projection 71*a* formed with an external thread, while the spacer plate 72 has a threaded inner periphery and is threadedly connected with the pressure plate 71. The upper surface of the frame member 6 carries a supporting plate 74 whose width is greater than the distance between the front and rear side walls 64, and which supports a pneumatic or hydraulic cylinder-piston device 75 connected thereto by means of bolts or the like. The cylinder-piston device 75 has a piston rod extending through an elongate slot 67 formed in the bottom wall 65 of the frame member 6, with its lower end threaded into the pressure plate 71 and rigidly secured thereto.

Figure 5:
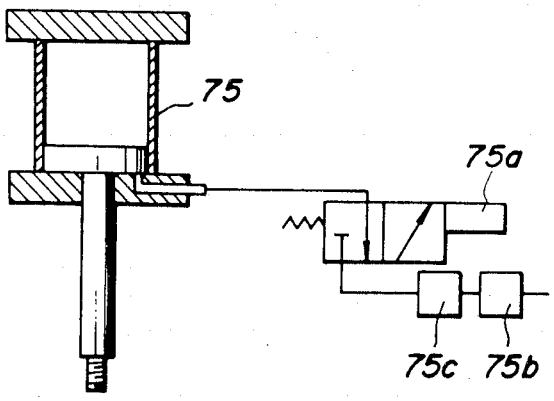
FIG. 5 is a diagram of an operating pneumatic circuit of the cylinder-piston device shown in FIGS. 4A and 4B.

The device 75 preferably is of pneumatic type, having an associated control circuit substantially as shown in FIG. 5. The control circuit includes a solenoid-operated valve 75*a*, and may be arranged in such a manner that, when the machine is not in operation, the piston rod of the device 75 assumes the lowermost position as shown in FIG. 5, under the weight of the piston and piston rod as well as the pressure plate 71 and spacer plate 72 both connected to the latter, while when the machine is to be operated and the solenoid-operated valve 75*a* is actuated, the piston rod is retracted upwardly into the cylinder by means of the air pressure supplied through the valve 75*a*. Preferably, the control circuit for the cylinder-piston device 75 further includes a source 75*b* of lubricating oil mist to be mixed with the compressed air, and a pressure regulator 75*c*.

The location of the cylinder-piston device 75 can be adjusted longitudinally of the upper frame member 6, corresponding to the exact location of the dies $D_1$, $D_2$, $D_3$, $D_4$, since the supporting plate 74 is not connected to, but simply mounted on the frame member 6. However, during the continuous operation of the machine, the cylinder-piston device 75 together with associated pressure plate 71 may slightly displace in the longitudinal direction of the frame member 6 due to the machine vibration. Thus, in order to avoid such an undesirable longitudinal displacement, the upper surface of the frame member 6 may be provided with a pair of rack-like bars 68 which can be engaged with corresponding pair of rack-like bars 76 (FIGS. 6B and 6C) provided on the lower surface of the supporting plate 74.

Figure 6A:
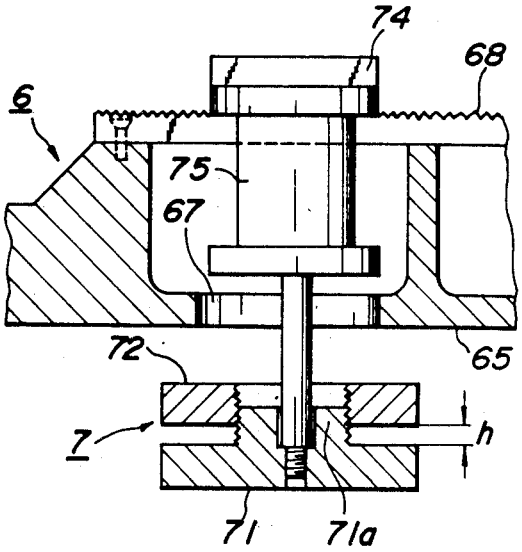
FIGS. 6A to 6C are sectional views showing the manner of adjusting the shut height with the arrangement of FIGS. 4A and 4B.
Figure 6B:
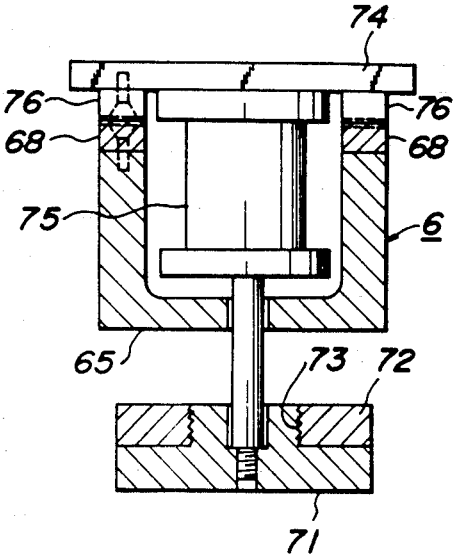
Figure 6C:
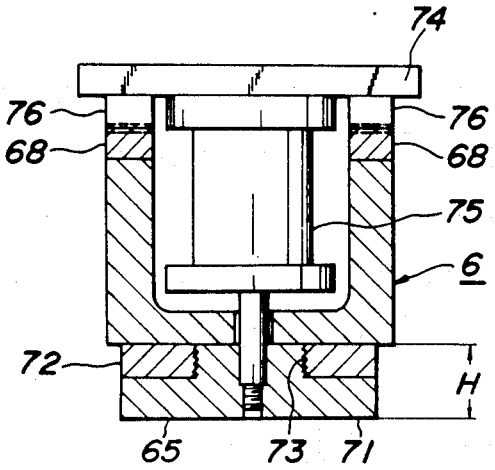

With such an arrangement of the machine, in order to adjust the shut height and hence the distance H between the lower surface of the upper frame member 6 and the lower surface of the pressure plate 71 (FIG. 4B), the solenoid-operated valve 75*a* for the cylinder-piston device 75 is switched into OFF-state as shown in FIG. 5 in the inoperative condition of the machine. By this, the compressed air within the cylinder is exhausted and the piston rod of the device 75 displaces downwardly into the lowermost position under the weight of the piston, piston rod, pressure plate 71 and spacer plate 72. This downward displacement of the piston rod may be assisted manually by an operating personnel. In the lowermost position of the piston rod of the device 75, as shown in FIG. 6A, a gap is formed between the upper surface of the spacer plate 72 and the lower surface 65 of the upper frame member 6. In this condition, the positioning of the pressure plate 71 longitudinally of the frame member 6 can be effected to obtain an optimum alignment of the pressure plate 71 with respect to the relevant die, by displacing the cylinder-piston device 75 horizontally along the slot 67 in the bottom wall 65 of the frame member 6. Also, the shut height can be adjusted by adjusting the distance h between the upper surface of the pressure plate 71 and the lower surface of the spacer plate 72 (FIG. 6A). For example, if the shut height is to be increased, the pressure plate 71 is manually kept from rotation while the spacer plate 72 is rotated clockwisely. This clockwise rotation results in the downward displacement of the spacer plate 72, the amount of which corresponds to the increment in the shut height. On the other hand, the shut height can be decreased by rotating the spacer plate 72 counterclockwisely. When the desired adjustment of the shut height is completed, the solenoid-operated valve 75*a* is switched into ON-state permitting compressed air to be supplied into the cylinder of the cylinder-piston device 75, by which the piston rod is displaced upwardly together with the pressure plate 71 and the spacer plate 72 until the upper surface of the spacer plate 72 abuts with the lower surface 65 of the upper frame member 6. By maintaining the compressed air supply to the cylinder-piston device 75, the vertical position of the pressure plate 71 with respect to the upper frame member 6 can be positively fixed and kept constant, thus providing a desired constant shut height.

Figure 7A:
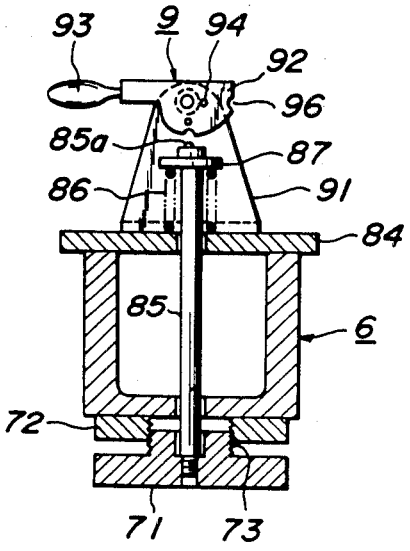
FIGS. 7A and 7B are cross-sectional view and longitudinal-sectional view of the shut height adjusting means according to another embodiment of the present invention.
Figure 7B:
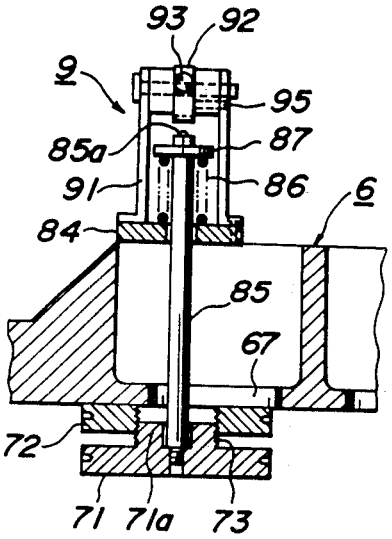

FIGS. 7A and 7B show another embodiment of the present invention, wherein means to individually adjust the shut height with respect to each die includes, besides the above-mentioned pressure plate 71 and spacer plate 72, a vertically extending supporting rod 85 and a compression spring 86 which support and urge the two plates upwardly toward the upper frame member 6. The rod 85 has a lower end extending through the slot 67 in the bottom wall 65 of the frame member 6, which end is threadedly connected to the pressure plate 71. The upper portion of the supporting rod 85 projects beyond the upper surface of the frame member 6, and has a collar 87 integrally secured thereto. The compression spring 86 is arranged about the upper portion of the supporting rod 85 and axially between the collar 87 and a supporting plate 84 movably mounted on the upper surface of the frame member 6.

The shut height is adjusted with the spacer plate 72 spaced from the lower surface of the frame member 6 against the force of the spring 86. This may be assisted by an operating cam mechanism 9 including a bracket 91 integrally secured to the supporting plate 84, and an eccentric cam plate 92 rotatably carried by the bracket 91 and provided with an operating handle 93. The cam plate 92 is formed with a pair of recesses 94 on its one side surface (FIG. 7A). adapted to be engaged by a spring-loaded plunger 95 which is provided as a positioning element. The cam plate is further formed with a pair of recesses 96 on its outer peripheral surface, adapted to be engaged by a projection 85*a* upwardly protruding from the upper end of the supporting rod 85.

Figure 8A:
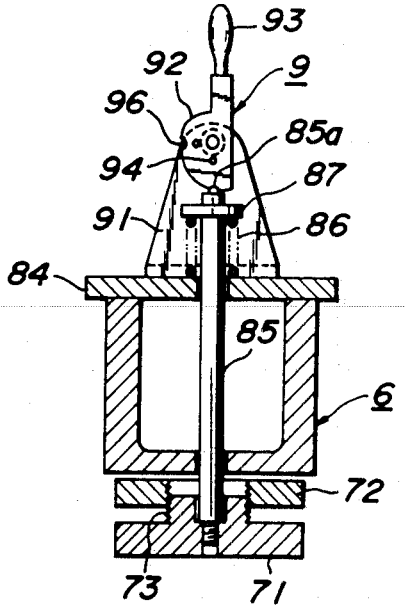
FIGS. 8A and 8B are cross-sectional views showing the manner of adjusting the shut height with the arrangement of FIGS. 7A and 7B.
Figure 8B:
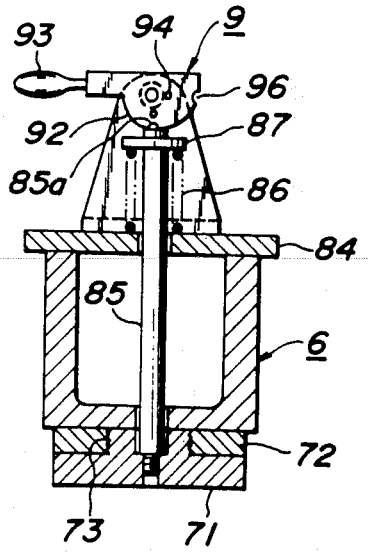

In the position of the operating handle 93 shown in FIGS. 7A and 7B, the compression spring 86 urges the supporting rod 85 upwardly so that the spacer plate 72 is in contact with the lower surface of the frame member 6. The plunger 95 is in engagement with one of the side recesses 94 of the cam plate 92, thereby angularly positioning the cam plate 92. In order to space the plate 72 from the frame member 6 and effect an adjustment of the shut height, the operating handle 93 and the cam plate 92 are rotated clockwisely until the plunger 95 comes into engagement with the other of the side recesses 94 of the cam plate 92. During this rotation, the peripheral cam surface of the plate 92 comes into contact with the projection 85*a* and displaces the supporting rod 85 downwardly against the force of the compression spring 86. In so rotated position of the cam plate 92, as shown in FIG. 8A, the projection 85*a* of the supporting rod 85 engages with one of the peripheral recesses 96 of the cam plate 92, and the operating handle 93 assumes an upright position. Furthermore, the spacer plate 72 is spaced from the lower surface of the frame member 6 so that a necessary adjustment of the shut height can be effected in essentially the same manner as that described with reference to FIGS. 6A, 6B, 6C. After completion of the adjustment, the operating handle 93 and the cam plate 92 are rotated counterclockwisely and returned to the initial position, so that the compression spring 86 urges the spacer plate 72 upwardly against the lower surface of the frame member 6. FIG. 8C shows thus adjusted position in which the shut height is increased and the projection 85*a* of the supporting rod 85 engages with the other of the peripheral recesses 96 of the cam plate 92 corresponding to the increment of the shut height.

Figure 9:
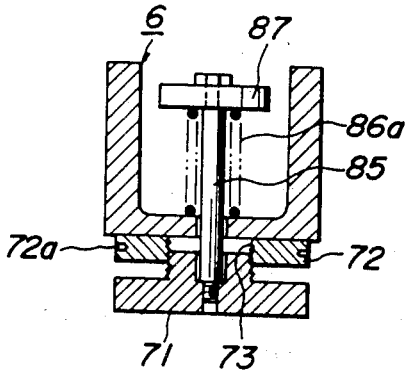
FIGS. 9, 10 and 11 are cross-sectional views of various modifications of the arrangement shown in FIGS. 7A and 7B.

FIG. 9 shows another embodiment of the present invention, which is similar to that shown in FIGS. 7A and 7B, but which is not combined with the operating cam mechanism. Here, the spacer plate 72 on its outer peripheral surface is formed with at least one recess 72a adapted to be engaged by an appropriate tool for rotating the spacer plate 72 in a desired direction to achieve the adjustment of the shut height.

Figure 10:
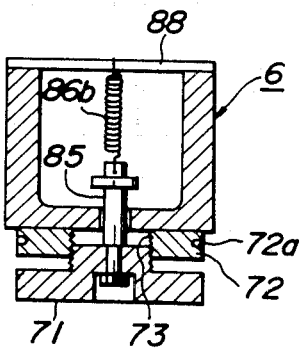

FIG. 10 shows another embodiment of the present invention, wherein the compression spring 86*a* is replaced by a tension spring 86*b* whose upper end is supported by a cross bar 88 bridging the front and rear side walls of the frame member 6.

Figure 11:
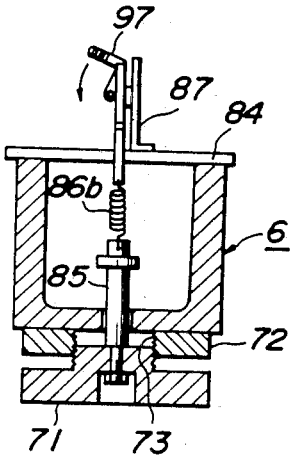

Still another embodiment is shown in FIG. 11, wherein the upper end of the tension spring 86*b* is connected with a toggle lever 97 which is supported by a bracket 87 on a supporting plate 84 mounted on the frame member 6. In the illustrated position of the toggle lever 97, the tension applied by the spring 86*b* urges the spacer plate 72 against the lower surface of the frame member 6 to maintain the desired shut height. When the toggle lever 97 is rotated counterclockwisely in FIG. 11, the upper end of the spring 86*b* is lowered resulting in the downward displacement of the supporting rod 85 and of the spacer plate 72 and pressure plate 71. Thus, a necessary adjustment of the shut height can be effected by rotating the spacer plate 72 relative to the pressure plate 71.

Figure 12:
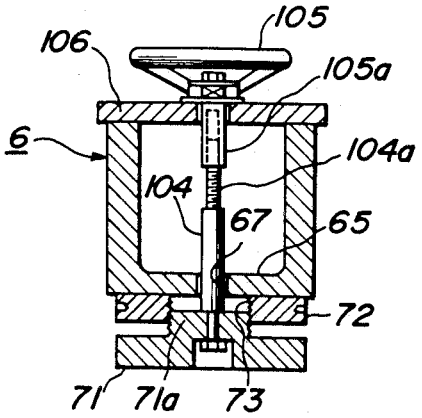
FIG. 12 is a cross-sectional view of the shut height adjusting means according to still another embodiment of the present invention.
Figure 13A:
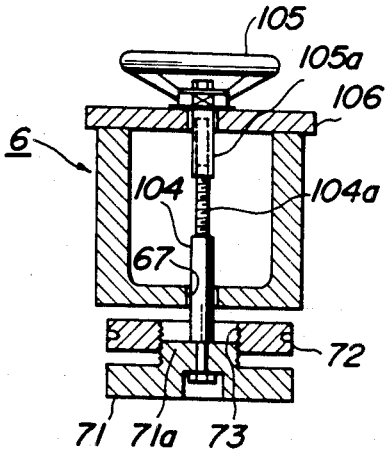
FIGS. 13A and 13B are cross-sectional views showing the manner of adjusting the shut height with the arrangement of FIG. 12.
Figure 13B:
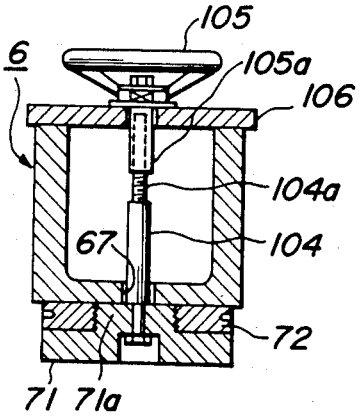

FIG. 12 shows another embodiment of the present invention, wherein means to individually adjust the shut height with respect to each die includes, besides the pressure plate 71 and spacer plate 72, a vertically extending supporting rod 104 with its lower end fixedly secured to the pressure plate 71 and its upper end formed as an external thread 104*a*, and an operating handle 105 having a boss fixedly secured to a downwardly extending sleeve 105*a* with an internal thread cooperating with the external thread 104*a*, and rotatably supported by a supporting plate 106 mounted on the upper frame member 6. With such an arrangement, a necessary adjustment of the shut height can be effected by rotating the operating handle 105 counterclockwisely to downwardly displace the supporting rod 104 such that the spacer plate 72 is spaced from the lower surface of the frame member 6 as shown in FIG. 13A. By this, the spacer plate 72 can be rotated in the desired direction relative to the pressure plate 71 either to increase or decrease the shut height. The adjusted shut height can be maintained by rotating the operating handle 105 clockwisely, until the spacer plate 72 abuts with the lower surface of the frame member (FIG. 13B).

The various embodiments thus far described provide following marked advantages. First, since the shut height of the respective dies can be individually adjusted simply, by an axial positioning of the spacer plate 72 with respect to the pressure plate 71, the time required to change, set and adjust the dies can be minimized. Second, when the pressure plate 71 is urged against the die, the pressure is transmitted to the upper frame member 6 through the spacer plate 72 but not to the means for adjustably supporting the pressure plate 72, so that a high durability of the arrangement can be obtained. Third, the arrangement is very simple in construction and thus, the manufacturing cost of the press machine can be considerably reduced when compared with conventional crank press machine having a bolster of substantially the same size.

Practically, after the shut height is adjusted to a theoretically determined value, a so-called trial operation is required in order to ascertain whether or not the adjusted shut height is actually optimum. To effect such a trial operation, sample raw material is firstly inserted into, or placed on a drawing die, for example, which substantially projects toward the ram. If, however, the trial operation is carried out under a normal working pressure, the work finishing point of the die may be reached before the lower dead point of the stroke is reached. In such a case, the pressure plate is thrust into the die, by which the machine cannot be further operated. Removal of the pressure plate requires an extremely troublesome manipulation and, in the worst case, results in that either the die is destroyed or the machine itself is deformed.

Figure 14:
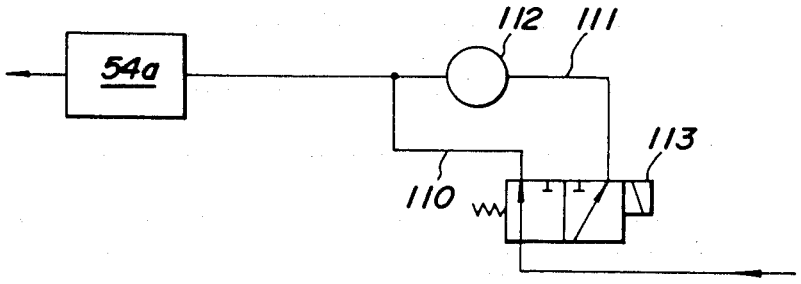
FIG. 14 is a diagram of a pneumatic control circuit used to reduce the operating force of the press machine during the trial operation.

The above-mentioned problem can be eliminated by the arrangement shown in FIG. 14, which is combined with the clutch 54 (FIG. 3A) which now consists of a pneumatically actuated friction disc-type clutch incorporating therein a diaphragm, and which is connected with a clutch operating valve 54*a*. This valve 54*a* is connected with a compressed air passage 110 which supplies the valve 54*a* with compressed air under normal working pressure, i.e. approximately 5.5 kg/cm$^2$, and with a further compressed air passage 111 which includes a pressure reducing valve 112 and supplies the valve 54*a* with compressed air under relatively reduced working pressure, i.e. approximately 2.5 kg/cm$^2$. These passages 110, 111 are selectively connected with the valve 54*a* by means of a solenoid-operated switchover valve 113.

Thus, when the trial operation is to be effected, the switchover valve 113 is actuated in such a manner that compressed air under reduced working pressure is supplied from the pressure reducing valve 112 to the clutch operating valve 54*a*. By this, the upper frame member 6 and all the pressure plates are displaced downwardly toward the dies $D_1$, $D_2$, $D_3$, $D_4$ (FIG. 3A) with a reduced force. Since the trial operation is effected under a reduced force, the pressure plate can be protected from being forcedly thrust into the die even when the theoretically adjusted shut height is actually not optimum. Furthermore, if the theoretically determined shut height is not actually optimum, this fact can be recognized by observing so-called die marks which the die imparts to the sample raw material. Based on this observation, the shut height can be readjusted from the theoretically determined value to the actually optimum value. Once an actually optimum shut height is achieved, actual production can be carried out by actuating the solenoid operated switchover valve 113 such that normal working pressure is supplied to the clutch operating valve 54*a* and the machine is operated under a normal working force.

Figure 15A:
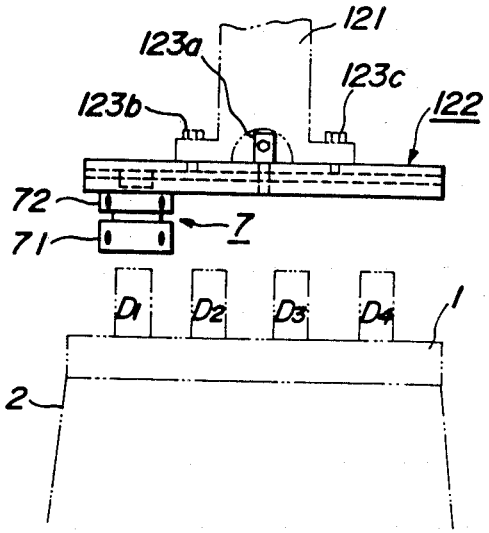
FIGS. 15A and 15B are front view and side view of shut height adjusting means according to another embodiment of the present invention, which may be combined with an existing conventional press machine.
Figure 15B:
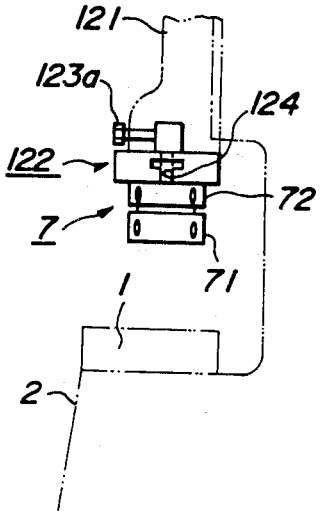
Figure 16A:
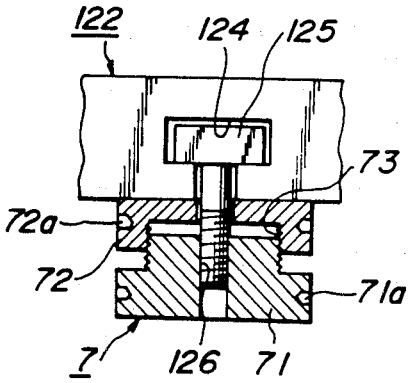
FIG. 16A is an enlarged fragmentary cross-sectional view of the adjusting means shown in FIGS. 15A and 15B.
Figure 17:
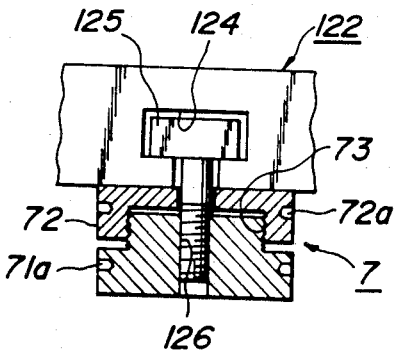
FIG. 17 is a sectional view showing the manner of adjusting the shut height with the arrangement of FIGS. 15A and 15B.
Figure 16B:
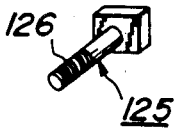
FIG. 16B is a perspective view of a pressure plate supporting rod used in the arrangement of FIGS. 15A and 15B.

FIGS. 15A and 15B show still another embodiment of the present invention, which may readily be applied to existing conventional hydraulic ram-type press machine including a machine frame 2, which fixedly mounts thereon a die bolster 1 for a plurality of dies $D_1$, $D_2$, $D_3$, $D_4$, and a mechanically operated ram 121 vertically reciprocably arranged above the bolster 1. According to the present embodiment, a pressure plate supporting structure 122 is detachably secured to the ram 121 by bolts 123*a*, 123*b*, 123*c*. This structure 122 consists essentially of a rectangular steel plate whose length is as same as, or slightly smaller than the bolster 1, and has on its upper surface a semicylindrical projection which is received in a correspondingly shaped recess in the lower surface of the ram 121. The lower surface of the structure 122 is formed with a continuous longitudinal groove 124 having a T-shaped cross-section (FIG. 15B). In this embodiment also, the means 7 to adjust the shut height includes the pressure plate 71 and spacer plate 72 which are threadedly connected with each other. The pressure plate 71 is supported by the structure 122 through a supporting rod 125 whose substantially T-shaped head is received by the groove 124 and whose lower portion 126 is threaded into the pressure plate 71 (FIGS. 16A and 16B). Preferably, the thread for connecting the rod 125 with the pressure plate 71 has a pitch different from that of the thread for connecting the pressure plate 71 with the spacer plate 72. Alternatively, these two threads may be reverse handed with respect to each other. By this, when the shut height is adjusted by rotating the spacer plate 71 relative to the pressure plate 71, undesired rotation between the pressure plate 71 and the supporting rod 125 can be prevented effectively. The location of the pressure plate 71 with respect to the associated die can be adjusted longitudinally of the supporting structure 122 by moving the supporting rod 125 along the T-shaped groove 124, so that an optimum alignment can be obtained.

Figure 18A:
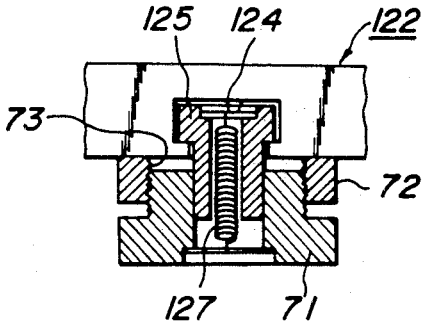
FIGS. 18A to 18C show a modification of the arrangement of FIGS. 15A and 15B.
Figure 18B:
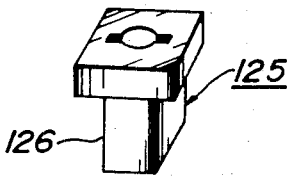
Figure 18C:
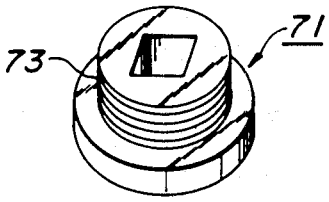

FIGS. 18A to 18C show a modification of the arrangement of FIGS. 15A and 15B, wherein the supporting rod 125 is connected with the pressure plate 71 through a tension spring 127. The rod 125 has a square cross-section, and is formed with an axial center bore in which the spring 127 is arranged with its one end engaged with the top portion of the rod 125, and the other end engaged with the pressure plate 71. Because of the square cross-section of the rod 125, relative rotation between the rod 125 and the pressure plate 71 is prevented when the spacer plate 72 is rotated relative to the pressure plate 71 in order to adjust the shut height.

It will be appreciated from the foregoing description that the present invention makes it possible to adjust the shut height of the press machine very easily and in short a time, so that the productivity of the machine when producing various kind of components and parts can be improved considerably. Although the present invention has been explained with respect to specific embodiments, varius alternations and modifications can be made by those skilled in the art, without departing from the scope of the invention.

What is claimed is:

1. A press machine, comprising a stationary frame member, a bolster which is fixedly mounted on the stationary frame member and on which a plurality of press dies are fixedly secured, and a movable frame member arranged reciprocably with respect to the stationary frame member and having a predetermined constant stroke, said movable frame member carrying a plurality of pressure plates cooperating with the press dies, respectively, each pressure plate being supported by the movable frame member to be movable in a first direction relative thereto and being threadedly connected with a spacer plate disposed between a surface of the movable frame member and a surface of the pressure plate opposite to said surface of the movable frame member, whereby the spacer plate is rotatable relative to the pressure plate to provide a desired shut height, each pressure plate being supported by the movable frame member to be displaceable in a longitudinal direction of said movable frame member, said longitudinal direction being substantially normal to said first direction.

2. A press machine, comprising a stationary frame member, a bolster which is fixedly mounted on the stationary frame member and on which a plurality of press dies are fixedly secured, and a movable frame member arranged reciprocably with respect to the stationary frame member and having a predetermined constant stroke, said movable frame member carrying a plurality of pressure plates cooperating with the press dies, respectively, each pressure plate being supported by the movable frame member to be movable in a first direction relative thereto and being threadedly connected with a spacer plate disposed between a surface of the movable frame member and a surface of the pressure plate opposite to said surface of the movable frame member, whereby the spacer plate is rotatable relative to the pressure plate to provide a desired shut height, each pressure plate being supported by the movable frame member through a cylinder-piston device having a piston rod movable between a first position in which the spacer plate is in engagement with said surface of the movable frame member and a second position in which the spacer plate is disengaged from said surface of the movable frame member to enable adjustment of the shut height.

3. A press machine, comprising a stationary frame member, a bolster which is fixedly mounted on the stationary frame member and on which a plurality of press dies are fixedly secured, and a movable frame member arranged reciprocably with respect to the stationary frame member and having a predetermined constant stroke, said movable frame member carrying a plurality of pressure plates cooperating with the press dies, respectively, each pressure plate being supported by the movable frame member to be movable in a first direction relative thereto and being threadedly connected with a spacer plate disposed between a surface of the movable frame member and a surface of the pressure plate opposite to said surface of the movable frame member, whereby the spacer plate is rotatable relative to the pressure plate to provide a desired shut height, each pressure plate being supported by the movable frame member through a spring which urges the spacer plate against said surface of the movable frame member.

4. The press machine as claimed in claim 3, wherein one end of the spring is in engagement with a supporting rod which include a lower end fixedly connected with the pressure plate.

5. The press machine as claimed in claim 4, wherein an end of the supporting rod cooperates with a cam plate pivotably supported relative to said stationary frame member and connected with an operating handle, the cam plate having a first position in which the supporting rod assumes a position in which the spacer plate is in contact with said surface of the movable frame member, and a second position in which the supporting rod assumes a position with a spacer plate spaced from the movable frame member.

6. The press machine as claimed in claim 3, wherein the spring comprises a tension spring having one end connected with a toggle lever for alternately applying and releasing a spring force of said tension spring relative to said pressure plate.

7. A press machine, comprising a stationary frame member, a bolster which is fixedly mounted on the stationary frame member and on which a plurality of press dies are fixedly secured, and a movable frame member arranged reciprocably with respect to the stationary frame member and having a predetermined constant stroke, said movable frame member carrying a plurality of pressure plates cooperating with the press dies respectively, each pressure plate being supported by the movable frame member to be movable in a first direction relative thereto and being threadedly connected with a spacer plate disposed between a surface of the movable frame member and a surface of the pressure plate opposite to said surface of the movable frame member, whereby the spacer plate is rotatable relative to the pressure plate to provide a desired shut height, and wherein each pressure plate is supported by the movable frame member through a supporting rod having an end threadedly connected with the pressure plate and another end threadedly connected with an operating handle for causing the supporting rod to be displaced vertically with respect to the movable frame member by operating the handle.

8. A press machine, comprising a stationary frame member, a bolster which is fixedly mounted on the stationary frame member and on which a plurality of press dies are fixedly secured, a movable member arranged reciprocably with respect to the stationary frame member and having a predetermined constant stroke, and a supporting means carrying a plurality of pressure plates for cooperating with the press dies, respectively, and being detachably secured to the movable member, each pressure plate being supported by the movable member to be movable in a first direction relative thereto, and a spacer plate threadedly connected with the pressure plate and arranged between a surface of the supporting means and a surface of the pressure plate which is opposite to said surface of the support means, whereby the spacer plate is rotatable relative to the pressure plate to provide a desired shut height, the pressure plate being supported by the supporting means through a supporting rod having an end threadedly connected with the pressure plate.

9. The press machine as claimed in claim 8, wherein the pressure plate and the spacer plate are connected with each other by a threading having a pitch different from a pitch of a threading connecting the pressure plate and the supporting rod with each other.

10. The press machine as claimed in claim 8, wherein the threading connecting the pressure plate with the spacer plate and the threading connecting the pressure plate with the supporting rod are reverse handed with respect to each other.

11. A press machine, comprising a stationary frame member, a bolster which is fixedly mounted on the stationary frame member and on which a plurality of press dies are fixedly secured, a movable member arranged reciprocably with respect to the stationary frame member and having a predetermined constant stroke, and a supporting means carrying a plurality of pressure plates for cooperating with the press dies, respectively, and being detachably secured to the movable member, each pressure plate being supported by the movable member to be movable in a first direction relative thereto, and a spacer plate threadedly connected with the pressure plate and arranged between a surface of the supporting means and a surface of the pressure plate which is opposite to said surface of the support means, whereby the spacer plate is rotatable relative to the pressure plate to provide a desired shut height, the pressure plate being supported by the supporting means through a spring, and fits with an end of a rod having a square cross-section which is supported by the supporting means.

12. The press machine as claimed in claim 8 or 11, wherein the supporting means has a longitudinally extending groove which receives a head of the rod, and the head of the rod is movable along the groove.

* * * * *

UNITED STATES PATENT AND TRADEMARK OFFICE

CERTIFICATE OF CORRECTION

PATENT NO. : 4,676,090

DATED : June 30, 1987

INVENTOR(S) : Tatsuo NISHIMURA, et al

It is certified that error appears in the above-identified patent and that said Letters Patent is hereby corrected as shown below:

Title page, [30] Foreign Application Priority Data, the following is added to the priority documents.

AUGUST 31, 1984 [JP] Japan.....59-183,324.

Signed and Sealed this

Twenty-seventh Day of September, 1988

*Attest:*

DONALD J. QUIGG

*Attesting Officer*

*Commissioner of Patents and Trademarks*